US007118500B2

(12) United States Patent
Nye et al.

(10) Patent No.: US 7,118,500 B2
(45) **Date of Patent: *Oct. 10, 2006**

(54) PORTABLE BASKETBALL SYSTEM

(75) Inventors: S. Curtis Nye, Clinton, UT (US); Carl R. Stanford, Clinton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/648,174

(22) Filed: Aug. 26, 2003

(65) Prior Publication Data

US 2004/0092341 A1 May 13, 2004

Related U.S. Application Data

(63) Continuation-in-part of application No. 10/050,612, filed on Jan. 16, 2002, now Pat. No. 6,656,065.

(51) Int. Cl.
*A63B 63/08* (2006.01)

(52) U.S. Cl. ..... 473/481; 473/479; 254/9 R

(58) Field of Classification Search ..... 473/438, 473/481, 433, 415, 436, 472, 479; 254/9 R; 280/43.17, 46; 16/32–34; 188/7
See application file for complete search history.

(56) References Cited

U.S. PATENT DOCUMENTS

| | | | |
|---|---|---|---|
| 221,713 | A | 11/1879 | Allen |
| 865,987 | A | 9/1907 | Barlow |
| 1,135,603 | A | 4/1915 | Mead |
| 1,588,419 | A | 6/1926 | Hickey |
| 1,924,811 | A | 8/1933 | Schultz |
| 2,061,929 | A | 11/1936 | Ames |
| 2,077,265 | A | 4/1937 | Reed |
| 2,111,554 | A | 3/1938 | Clark |
| 2,144,148 | A | 1/1939 | Gross |
| 2,217,893 | A | 10/1940 | Dunajeff |

(Continued)

FOREIGN PATENT DOCUMENTS

| | | |
|---|---|---|
| CA | 2302005 | 9/2000 |

(Continued)

OTHER PUBLICATIONS

Huffy Sports, 2003 Product Catalog, 28 pages.

(Continued)

*Primary Examiner*—Eugene Kim
*Assistant Examiner*—M. Chambers
(74) *Attorney, Agent, or Firm*—Workman Nydegger

(57) ABSTRACT

The portable basketball system allows a basketball goal to be positioned in a desired location and readily moved to another location. The portable basketball system may include a basketball goal, a pole or support structure that supports the basketball goal above a playing surface, and a base that maintains the support structure in a generally upward direction. The portable basketball system may also include an adjustment assembly that is capable of being moved between a first position in which the portable basketball system is held in a generally fixed position relative to the playing surface and a second position in which the portable basketball system is readily movable relative to the playing surface. The adjustment assembly may include a bracket, an arm, a link pivotally connecting the arm to the bracket, and a wheel assembly connected to the bracket. Desirably, at least a portion of the base contacts the playing surface when the adjustment assembly is in the first position to maintain the basketball goal in the generally fixed location.

42 Claims, 6 Drawing Sheets

U.S. PATENT DOCUMENTS 2,227,310 A 12/1940 Hoppes et al.
2,266,398 A 12/1941 Quayle
2,339,940 A 1/1944 Noros
2,426,723 A 9/1947 Barrett
2,472,989 A 6/1949 Skipper et al.
2,624,469 A 1/1953 Cadwell et al.
2,710,197 A 6/1955 Combs
2,759,738 A 8/1956 Reiter
2,783,055 A 2/1957 Michaud
2,812,951 A 11/1957 Hanson
2,829,390 A 4/1958 Noland
2,939,705 A 6/1960 McCall Jr.
2,986,395 A 5/1961 Sheftel
3,137,502 A 6/1964 Duganich
3,217,839 A 11/1965 Watkins et al.
3,404,884 A 10/1968 Sorensen et al.
3,423,101 A 1/1969 Boeye
3,427,025 A 2/1969 Procter
3,650,530 A 3/1972 Gantz
3,669,450 A 6/1972 Mason
3,716,234 A 2/1973 Lancellotti
3,841,631 A 10/1974 Dolan
3,999,753 A 12/1976 Desilets et al.
4,138,763 A 2/1979 Cooley
4,412,679 A 11/1983 Mahoney et al.
4,417,738 A 11/1983 Kendall
4,503,943 A 3/1985 Tsukui
4,526,367 A 7/1985 Haston et al.
4,759,545 A 7/1988 Grable
4,828,208 A 5/1989 Peterson et al.
4,940,232 A 7/1990 Chen
4,946,163 A 8/1990 Aakre et al.
5,014,983 A 5/1991 Saunders
5,039,109 A 8/1991 Mahoney et al.
5,112,407 A 5/1992 Sakai et al.
5,114,164 A 5/1992 Bothwell et al.
5,158,319 A 10/1992 Norcia et al.
5,193,828 A 3/1993 Benvenuti
5,207,407 A 5/1993 Fitzsimmons et al.
5,248,140 A 9/1993 Matherne et al.
5,249,438 A 10/1993 Rhaney et al.
5,259,612 A 11/1993 Matherne et al.
5,308,302 A 5/1994 Miller
5,313,817 A 5/1994 Meinders
5,348,326 A 9/1994 Fullenkamp et al.
5,354,049 A 10/1994 Matherne et al.
5,377,976 A 1/1995 Matherne et al.
5,390,914 A 2/1995 Schroeder
5,415,393 A 5/1995 Fitzsimmons et al.
5,425,547 A 6/1995 Payan
5,478,068 A 12/1995 Schroeder
5,518,233 A 5/1996 Williams
5,542,679 A 8/1996 Caso
5,571,229 A 11/1996 Fitzsimmons et al.
5,573,237 A 11/1996 Van Nimwegen et al.
5,613,676 A 3/1997 Connolly
5,615,451 A 4/1997 Peterson et al.
5,628,508 A 5/1997 Koole
5,628,522 A 5/1997 Hall
5,632,480 A 5/1997 Davis et al.
5,667,230 A 9/1997 Riley et al.
5,672,130 A 9/1997 O'Connell et al.
5,709,397 A 1/1998 Hall
5,716,186 A 2/1998 Jensen et al.
5,730,668 A 3/1998 Hege et al.
5,758,752 A 6/1998 King et al.
5,772,167 A 6/1998 Koole
5,775,650 A 7/1998 Fox
5,800,291 A 9/1998 Grover
5,823,550 A 10/1998 Bennett et al.
5,836,838 A 11/1998 van Nimwegen et al.
5,839,714 A 11/1998 Fitzsimmons et al.
5,865,691 A 2/1999 Chen
5,899,467 A 5/1999 Henkel
5,902,197 A 5/1999 Davis et al.
5,916,047 A 6/1999 Schickert
5,947,847 A 9/1999 van Nimwegen et al.
5,947,848 A 9/1999 Koole
6,001,034 A 12/1999 Schickert et al.
6,027,418 A 2/2000 van Nimwegen et al.
6,053,825 A 4/2000 Allen et al.
6,117,027 A 9/2000 Davis et al.
6,179,733 B1 1/2001 Story
6,338,686 B1 1/2002 King
6,412,747 B1 7/2002 Davis et al.
6,427,963 B1 * 8/2002 Davis et al. ..... 248/519
6,432,003 B1 * 8/2002 van Nimwegen ..... 473/481
6,656,065 B1 * 12/2003 Nye ..... 473/481
2001/0035481 A1 11/2001 Davis et al.
2001/0035485 A1 11/2001 Davis et al.
2001/0045498 A1 11/2001 Davis et al.
2001/0045501 A1 11/2001 Davis et al.
2003/0230692 A1 12/2003 Davis

FOREIGN PATENT DOCUMENTS

JP 03-212279 9/1991

OTHER PUBLICATIONS

Hydra-Rib, 2003 Product Catalog, 28 pages.
Huff Sports, 1999/2000 Product Catalog, 36 pages.
Legend™ "Air Time" Owner's Manual, Model No. LP305230, Proform Fitness Products Inc., 1994, 12 pages.

* cited by examiner

PORTABLE BASKETBALL SYSTEM

CROSS-REFERENCE TO RELATED APPLICATION

This application is a continuation-in-part of U.S. patent application Ser. No. 10/050,612, entitled WHEEL MOUNTED ADJUSTABLE ROLLER SUPPORT ASSEMBLY FOR A BASEKTBALL GOAL SYSTEM, filed on Jan. 16, 2002, now U.S. Pat. No. 6,656,065, which is incorporated by reference in its entirety.

BACKGROUND OF THE INVENTION

1. Field of the Invention

The present invention generally relates to portable sports systems and, in particular, to a portable basketball system.

2. Description of Related Art

The popularity of basketball, as well as the limited availability and/or expense associated with the use of gymnasiums or other permanent basketball facilities, has given rise to the development of various types of portable basketball standards. The portability of such basketball standards afford significant flexibility because they can be moved to any location where it is desired to play basketball. Moreover, portable basketball standards generally do not require installation of any type of permanent facilities in connection with their use. Further, the use of such portable basketball standards typically does not necessitate modifications to existing facilities or structures. Consequently, portable basketball standards allow basketball games to be played in virtually any location where there is a relatively flat support surface upon which the basketball standard can be located. The portability and relatively low cost of these types of basketball standards have contributed significantly to their popularity.

Conventional portable basketball standards often include a base, an elongated pole or post connected to the base, and a basketball backboard and a rim that are connected to an upper end of the elongated pole. In some cases, the height of the basketball goal above the playing surface can be varied to suit the desires of the user. For example, the height of the backboard and rim may be lowered to allow children to play and raised to allow adults to play.

The base of many conventional portable basketball standards may include a substantially hollow structure that provides for a relatively lightweight assembly which can be readily shipped by the manufacturer. The base may also include a removable fill/drain plug that allows the hollow portion of the base to be filled with ballast such as sand, dirt or water. When the hollow portion of the base is filled with ballast, the stability of the basketball standard is greatly enhanced. While the hollow base and ballast arrangement has proven useful, the weight of the ballasted base can be significant and it often impairs the ability of the user to move the basketball standard from one location to another location. For example, these known basketball systems may require the assistance of several people to set up or relocate the basketball standard when the base is filled with ballast. Alternatively, the ballast material may be emptied out of the hollow base to allow the basketball standard to be moved. Disadvantageously, the filling and emptying of the ballast material from the base each time the basketball standard is desired to be set up or moved requires a significant amount of time and is inherently inconvenient. In particular, if the hollow base is filled with water, then the water may have to be emptied onto the playing surface. On the other hand, removing sand or dirt for the hollow base may be very difficult and messy.

Conventional portable basketball standards may include one or more wheels incorporated into the support base to facilitate movement of the basketball standard. One known portable basketball standard includes a base with wheels attached to one end of the base and the basketball standard is moved by lifting and tilting the base onto the wheels located at the end of the base. In particular, the base is rotated from a generally horizontal position to a vertical position and the base wheels serve as a rotating fulcrum upon which the weight of the basketball standard is supported. Disadvantageously, pivoting the heavy base onto its wheels may be very difficult, if not impossible, for some people. The basketball standard may also be dropped or inadvertently released and that may cause injury to the user or others nearby. Additionally, because the user may use the elongated support pole to pivot the basketball standard, that may damage the base and/or the support pole. Further, the user bears a significant portion of the weight of the basketball standard when it is in the tilted position. This makes the basketball standard very difficult to move. Finally, this known basketball standard is difficult to maneuver because the elongated support pole is in a generally horizontal position.

Conventional portable basketball standards may also not allow lateral or sideways movement of base relative to the playing or support surface. This makes conventional portable basketball standards very difficult to move and position correctly because they primarily can only move in a forward and backward direction. In particular, these known portable basketball standards are often difficult to position in relatively small spaces.

Known portable basketball standards may also have one or more wheels that can be deployed to engage the ground. Disadvantageously, in order to position the wheels in the deployed position, the base may have to be tipped into a predetermined position. As discussed above, this type of approach is often problematic because the base is quite heavy and it may be very difficult or impossible for some users to tip the base. Additionally, the tipped base could fall over and injure the user or others. Thus, these known basketball standards often require several people to tip the base so that the basketball standard can be moved. The tipping of the portable basketball standard, however, may damage the support pole and/or the base, and this type of basketball standard also does not provide for lateral or sideways movement of the system.

BRIEF SUMMARY OF THE INVENTION

A need therefore exists for a portable basketball system that eliminates the above-described disadvantages and problems.

One aspect of the invention is a portable basketball system that includes a base, support structure and a basketball goal. The basketball goal may include a backboard and a rim. Advantageously, all or a portion of the portable basketball system could also be used in connection with other sports such as volleyball, soccer, and the like.

Another aspect is a portable basketball system with a basketball goal, a base, and a support structure that interconnects the base and the basketball goal. The base is preferably constructed from plastic and includes an interior cavity that is capable of receiving ballast material such as sand or water. Advantageously, filling the base with ballast material may provide a more secure and stationary system.

Yet another aspect is a portable basketball system with a wheel assembly that is capable of allowing the basketball system to be moved from one location to another location. The wheel assembly may include one or more wheels, rollers, casters, sliders or the like that are sized and configured to allow the basketball system to be moved. Advantageously, two or more wheel assemblies may be connected to the portable basketball system to facilitate movement of the basketball system.

Still another aspect is a portable basketball system with an adjustment assembly that is capable of moving between a stationary position in which the basketball system is held in a generally fixed position relative to a support or playing surface and a movable position in which the basketball system is movable relative to the support or playing surface. In particular, the adjustment assembly may be sized and configured to move the wheel assembly relative to the base. The adjustment assembly may include a bracket or clevis that is connected to the base and/or at least partially disposed within a recess in the base. The adjustment assembly may also include an arm or brace that is connected to the bracket and a link may connect the arm to the bracket. A handle or elongated support may be connected to the arm and movement of the handle may cause the adjustment assembly to move between the stationary position and the movable position.

A further aspect is a portable basketball system that may be steered or moved in a lateral or sideways direction. Desirably, the portable basketball system includes a wheel assembly that can pivot or rotate to allow the system to be moved or steered in a lateral or sideways direction. In particular, the adjustment assembly may include a bracket that is pivotally connected to the base to allow the basketball system to be steered and moved in a lateral or sideways direction.

Advantageously, the portable basketball system does not require significant tilting of the base when moving the basketball system. Additionally, the bottom portion of the base preferably remains generally parallel and proximate to the playing surface when moving the basketball system. This makes the portable basketball system much easier to move and position. Further, at least a portion of the base preferably contacts the playing surface when the basketball system is in the fixed position.

Yet another aspect is a portable basketball system that may include an adjustable transport assembly. The adjustable transport assembly may be sized and configured to move between a stationary position in which the portable basketball system is in a generally fixed position relative to a playing or support surface and a movable position in which the portable basketball system is readily movable relative to the playing or support surface. The portable basketball system may be configured to at least partially reside within a recess formed in the base. A bracket or clevis may be at least partially positioned within the recess formed in the base of the portable basketball system. The clevis may include a hole in its upper surface and one or more slots on either side of the clevis. A pin or bolt may pass through the hole in the upper surface to secure the clevis to the base and/or the support pole. Advantageously, this may allow the clevis to rotate or pivot relative to the base. The slots in the clevis are preferably sized and configured to receive an axle of a wheel assembly and the wheel assembly may include one or more wheels or rollers mounted to the axle. The wheels may be in continuous contact with the support surface or the wheels may be spaced apart from the support surface if desired. The axle, clevis and wheels are preferably sized and configured to permit the wheels to move relative to the base. In particular, the ends of the axle may protrude some distance through either side of the clevis and one or more arms or braces may be connected to the axle. The arms may also be connected to the clevis by one or more links. Preferably, a link is positioned on both sides of the clevis and the links are preferably connected at one end to an arm and at the other end to the clevis. A handle may be connected to the arms to permit movement of the adjustable transport assembly between first and movable positions.

In yet another aspect of the portable basketball system, when the handle moves downwardly toward the support or playing surface, the adjustment assembly moves from the stationary position towards the movable position. In particular, as the handle moves downwardly, the arm also moves because it is connected to the handle. The movement of the arm causes the links to move, and that moves the clevis and base upward into a raised position. The slots in the clevis permit the wheel assembly to remain in contact with the support or playing surface. Because the base is moved upwardly when the handle is moved downwardly, the lower portion of the base is either completely or substantially no longer in contact with the support surface. Thus, the weight of the portable basketball system is completely or substantially supported by the wheel assembly, the portable basketball system can now be readily moved. On the other hand, when the handle is moved away from the support surface, the arms and link cooperate to move the clevis and base towards the support surface. When at least a substantial portion of the base engages the support surface, the portable basketball system is held in a generally fixed position.

Advantageously, the portable basketball system requires few components and it can be quickly and easily assembled. The portable basketball system also provides a generally stationary and stable support for the basketball goal, and it provides a basketball system that can be quickly and easily moved from one location or another location. Additionally, the base of the portable basketball system is securely in contact with the ground when the system is in use, and the base can be quickly and easily spaced apart from the ground when it is desired to move the basketball system.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF PREFERRED EMBODIMENTS

The present invention is generally directed towards a portable basketball system. The principles of the present invention, however, are not limited to a portable basketball system. It will be understood that, in light of the present disclosure, the portable basketball system disclosed herein can be successfully used in connection with other types of sporting equipment such as volleyball standards and soccer goals.

Additionally, to assist in the description of the portable basketball system, words such as top, bottom, front, rear, right and left are used to describe the accompanying figures. It will be appreciated, however, that the portable basketball system can be located in a variety of desired positions. It will also be appreciated that the drawings are diagrammatic and schematic representations of preferred embodiments of the portable basketball system, and the drawings should not be considered as limiting the scope of the present invention nor are the drawings necessarily to scale.

Figure 1:
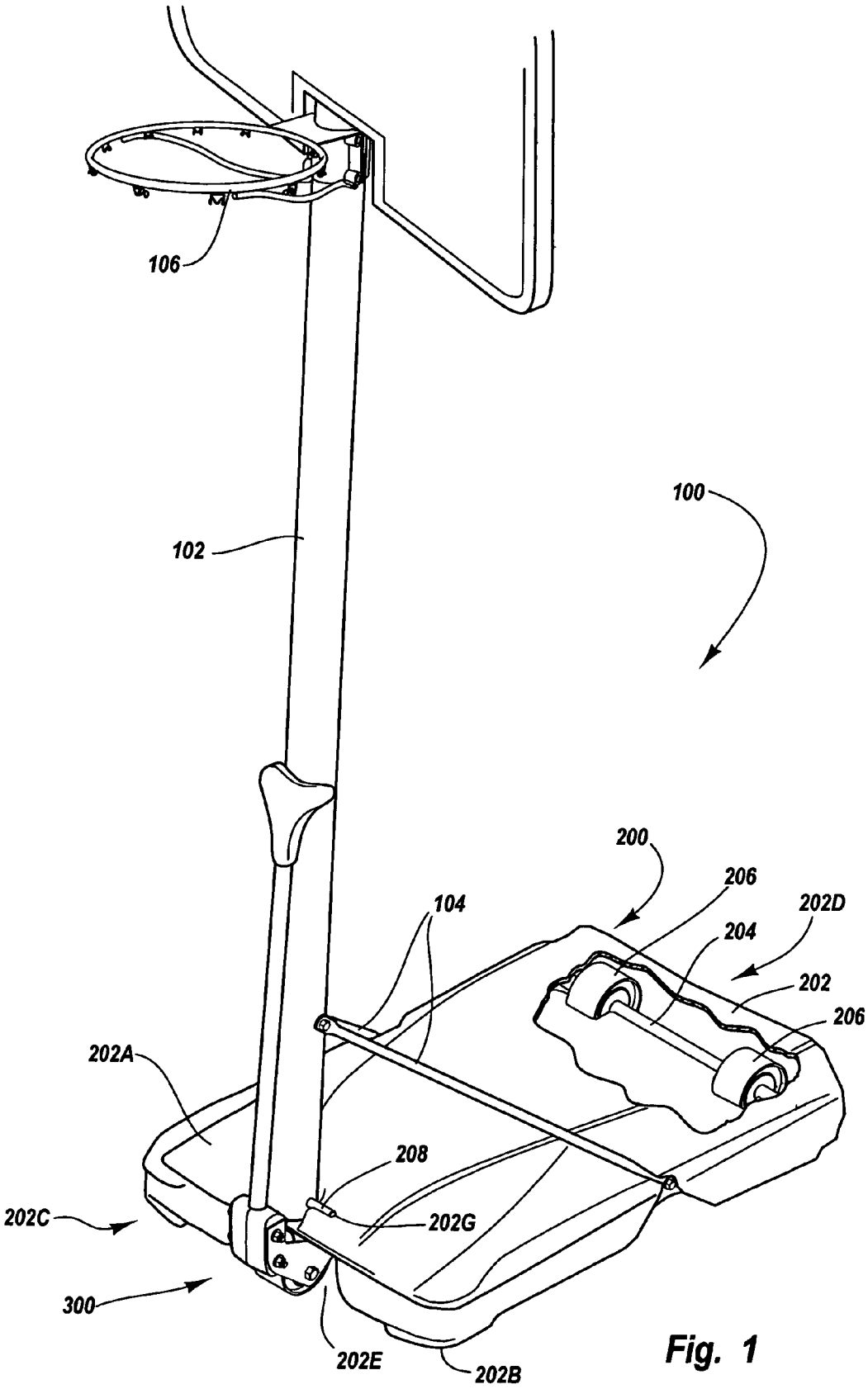
FIG. 1 is a perspective view of a portion of a portable basketball system in accordance with a preferred embodiment of the present invention.

As shown in FIG. 1, a portable basketball system 100 generally includes a base member 200 and an adjustable transport assembly 300. The portable basketball system 100 includes a post or other elongated member 102 that is attached to the base 200, as described in further detail below. In addition, a support structure 104, such as one or more braces, may be provided to connect the post 102 to the base 200. The support structure 104 desirably provides additionally stability and support to the post 102, but the support structure is not required. A basketball goal 106 is attached near the upper end of the post 102 and the basketball goal may include a rim and a backboard. One skilled in the art will understand that the height of the basketball goal 106 above a playing or support surface may be adjustable, if desired.

It should be noted that while preferred embodiments of the portable basketball system 100 discussed herein and shown in the accompanying figures are directed towards a portable basketball system, it will be appreciated that the invention disclosed herein could be used in connection with other types of devices and systems. For example, the disclosed invention could also be used in connection with other types of sports and sporting equipment. Additionally, the adjustable transport assembly 300, as well as the combination of the base 200 and the adjustable transport assembly 300, may be used in a variety of situations and environments. In particular, the adjustable transport assembly 300 and/or the base 200 may be employed in connection with structures such as volleyball net standards, tetherball standards, water polo standards, soccer goals or other similar structures. Further, in implementations where the base 200 or other structure to be moved is relatively large, multiple adjustable transport assemblies 300 may be used. Accordingly, one skilled in the art will appreciate that the portable basketball system 100, the base 200 and/or the adjustable transport assembly 300 may have a variety of suitable uses.

Figure 2:
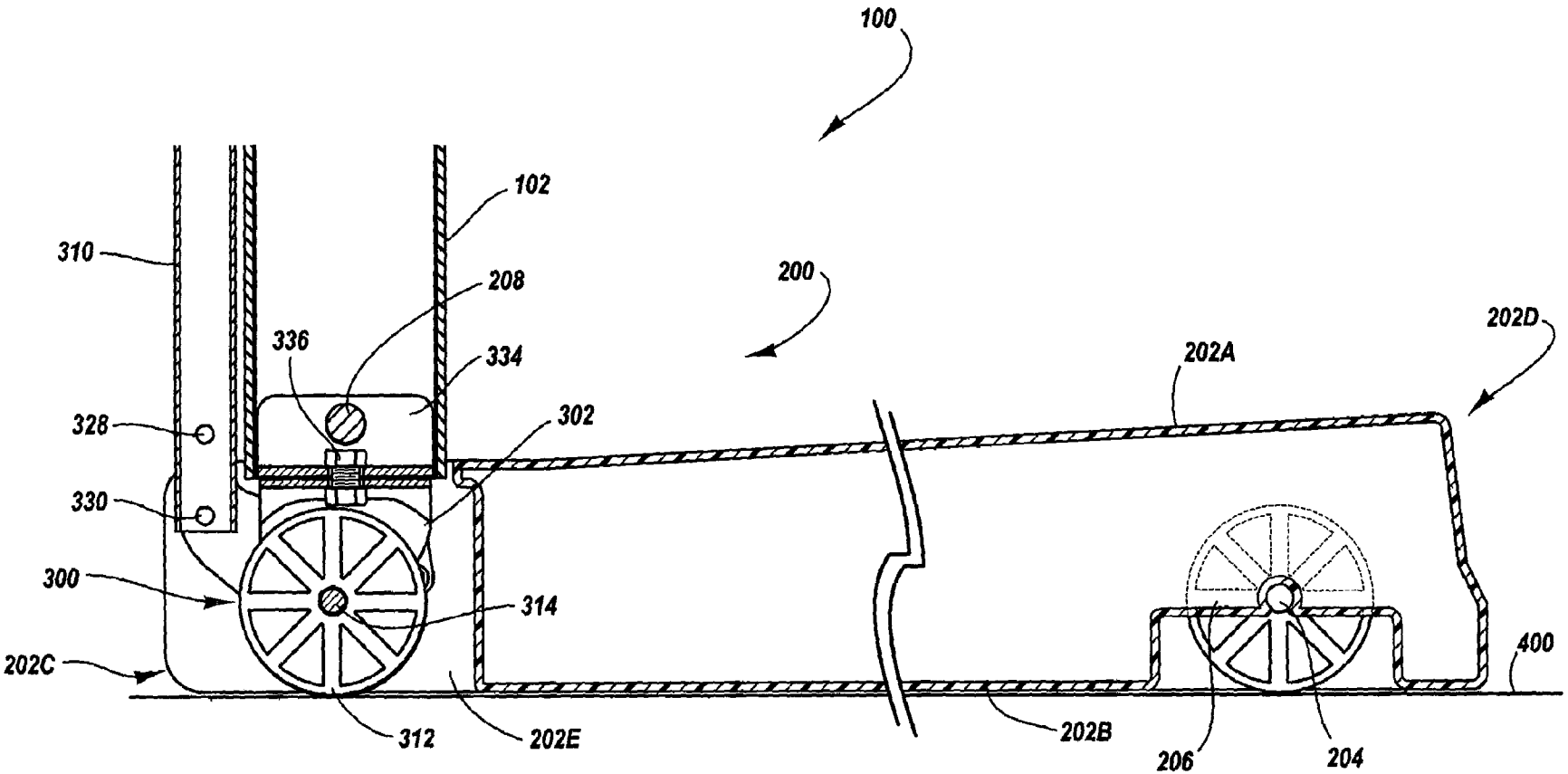
FIG. 2 is an enlarged partial cross-sectional side view of a portion of the portable basketball system shown in FIG. 1.

As best seen in FIGS. 1 and 2, the base 200 includes a body 202 with a top 202A, bottom 202B, a first end 202C and a second end 202D. As best illustrated in FIG. 2, the body 202 of the base 200 is preferably completely or substantially hollow, but only a portion of the base may be hollow depending, for example, upon the intended use of the portable basketball system 100. It will be appreciated, however, that the base 200 does not have to be hollow. The base 200 is preferably constructed from plastic or other suitable materials and the base can be formed by any suitable method such as blow molding, injection molding, and the like. A removable fill/drain plug (not shown) may permit the user to fill the generally hollow interior portion of the body 202 with suitable ballast such as sand or water so that the portable basketball system 100 can be reliably secured in position. The fill/drain plug is preferably located and configured so that if the body 202 is filled with water, for example, removal of the fill/drain plug enables the water to readily drain from the body 202.

One or more wheel assemblies are connected to the base 200 to facilitate movement of the portable basketball system 100. For example, a wheel assembly with an axle 204 and two wheels 206 may be connected proximate the second end 202D of the base 200. It will be appreciated that the wheel assembly could have any suitable number and/or type of axles, wheels, rollers, casters, sliders, etc., and the wheel assembly could be connected to the base by any suitable method such as an axle, pin, bolt, etc. It will also be appreciated that the wheel assembly may be connected to any suitable portion of the base 200 and more than one wheel assembly may be connected to the base depending, for upon, upon the size and configuration of the base.

The base 200 may also include a recess 202E that is located proximate the first end 202C of the base. The recess 202E is desirably located in the bottom portion 202B of the base 200, but the recess could be located in any suitable portion of the base. The recess 202E is preferably sized and configured to accommodate at least a portion of the adjustable transport assembly 300. In particular, a hole or opening 202F may be formed in the body 202 of the base 200 and a bolt, pin or other device may extend through the opening to connect the adjustable transport assembly 300 to the base. One skilled in the art will appreciate that the adjustable transport assembly 300 could be connected to the base 200 in any suitable manner depending, for example, upon the intended use of the portable basketball system 100.

As discussed above, the post 102 may be connected to the base 200. For example, a pin 208 may pass through one or more openings in the post 102 and the ends of the pin may be received within one or more recesses 202G formed in the base 200. The distal end of the post 102 may also be connected to a portion of the base 200 or a support plate to securely connect the post to the base. The post 102 may also be connected to the adjustable transport assembly 300 if desired. One skilled in the art will appreciate that the post 102 could be connected to the base 200 and/or the adjustable transport assembly 300 depending, for example, upon the intended use of the portable basketball system 1 00.

Figure 3:
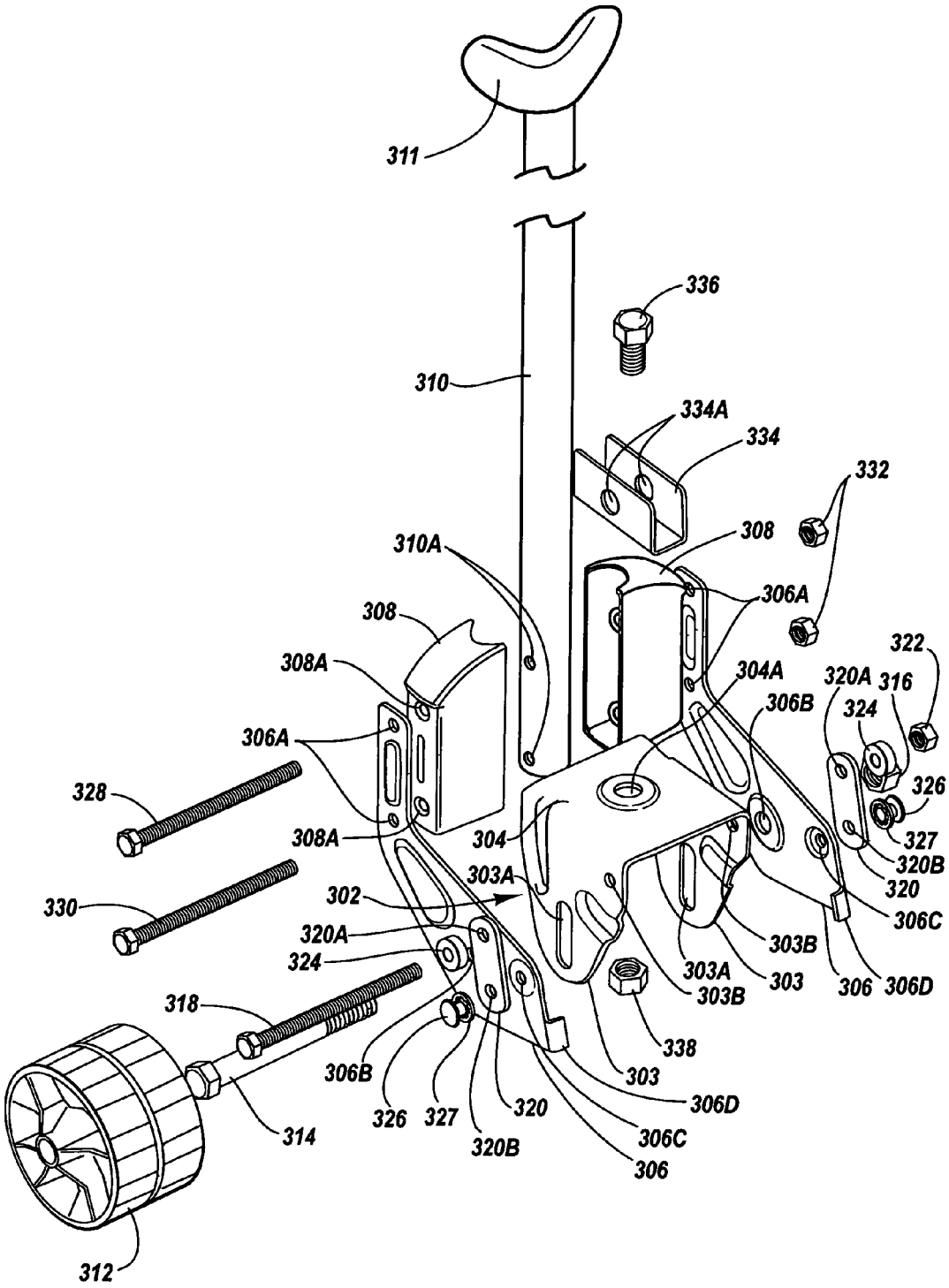
FIG. 3 is an enlarged, exploded perspective view of a portion of the portable basketball system shown in FIG. 1.

As best shown in FIGS. 2 and 3, the adjustable transport assembly 300 preferably includes a bracket or clevis 302. The bracket 302 preferably has a generally U-shaped configuration with two opposing side portions 303 that are joined together by a top portion 304. Each of the side portions 303 of the bracket 302 preferably includes a generally vertically oriented slot 303A and an opening or hole 303B, and the top portion 304 of the bracket also includes an opening or hole 304A. The bracket 302 is preferably constructed from a relative strong material such as metal, but any material with suitable characteristics may be used if desired.

The adjustable transport assembly 300 preferably also includes one or more arms, braces or linkages 306. Desirably, an arm 306 is disposed on each side of the bracket 302 and each arm includes an elongated flange that is sized and configured to be attached to a handle 310. In particular, the elongated flange on each arm 306 preferably includes a pair of openings or holes 306A that facilitate attachment of the handle 310 to the arm, as discussed in further detail below. Further, each are 306 preferably includes another opening or hole 306B that is sized and configured to allow a wheel assembly to be connected to the are. As discussed in more detail below, the openings 306B in the arms 306 are preferably sized and configured to receive an axle of the wheel assembly. Each of the arms 306 may also include an opening or hole 306C that, as discussed below, allows the arms to be attached to the bracket 302. In addition, each of the arms 306 may also include a stop 306D that is sized and configured to assist in controlling the movement of the adjustable transport assembly 300.

One skilled in the art will understand that the adjustable transport assembly 300 may include any suitable number of brackets 302, arms 306, and handles 310 depending, for example, upon the intended use of the portable basketball system 100. Thus, for instance, some implementations of the adjustable transport assembly 300 may employ only a single arm 306 while other implementations may include multiple arms. Additionally, the size and configuration of the bracket 302, arms 306 and handle 310 may vary, for example, depending upon the intended use of the adjustable transport assembly 300.

Two spacers or mounting assemblies 308 may be used to facilitate attachment of the handle 310 to the arms 306. In particular, the spacers 308 are preferably disposed between the arms 306 and the handle 310, and each of the spacers preferably includes a pair of holes 308A. The handle 310 also includes a pair of holes 310A and the holes in the handle are preferably aligned with the holes 308A in the spacers, which are also aligned with the holes 306A in the arms 306. As discussed below, two bolts 328, 330 are used to securely connect the handle 310, spacers 308 and arms 306. As shown in the accompanying figures, the handle 310 may include a grip 311 to assist in moving the portable basketball system 100. Although not shown in the accompanying figures, the handle 310 and/or the grip 311 may include a clip or other device that permits the handle to be removably secured to the post 102. Of course, the post 102 may include a clip or other device that allows the handle 310 and/or grip 311 to be removably secured to the post.

As best seen in FIG. 3, the adjustable transport assembly 300 includes a wheel assembly including a roller, wheel, slider or the like 312. The wheel 312 is preferably connected to an axle 314 and the wheel is preferably disposed at least partially within the bracket 302. In greater detail, the wheel 312 is disposed between the sides 303 of the bracket 302 and the wheel rotates or is connected to the axle 314. The axle 314, which may consist of a bolt or other suitable structure, preferably extends through the holes 306B in the arms 306 and the slots 303A in the sides 303 of the bracket 302. A nut 316 is connected to the end of the axle 314 to secure the axle in the desired location. It will be understood that pins or other suitable devices may also be used for axle 314, and one or more nuts or other similar structures may be used to secure the axle in the desired location.

The axis of rotation of the wheel 312 is in a fixed position relative to the arm 306 because the axle 314 is disposed within the holes 306B in the arm. The axis of rotation of the wheel 312, however, is not in a fixed position relative to the bracket 302 because the axle 314 is disposed within the slots 303A in the sides 303 of the bracket. As discussed below, this allows relative movement of the handle 310, arms 306 and wheel 312 relative to the bracket 302.

One or more links 320 are also used to connect the arms 306 to the bracket 302. Desirably, two links 320 are used to connect the two arms 306 to the bracket 302, but the number of links may depend, for example, upon the particular configuration of the adjustable transport assembly 300. Each of the links 320 preferably includes a first opening or hole 320A that is generally aligned with the holes 306C in the arms 306 and a bolt 318 is preferably used to connect the links to the arms. A nut 322 is preferably used to secure the bolt 318 in the desired location. A pair of bushings, washers, bearings, etc. 324 may be disposed between the bolt 318 and the links 320 and/or between the links and the bracket 302. Each of the links 320 may also include a second opening or hole 320B that is attached to the bracket 302 and a pin or fastener 326 is used to connect the links to the bracket. The pin 326 is retained in position by a clip 327 or other suitable structure. It will be appreciated that the links 320 may be connected to the arms 306 and/or bracket 302 in any suitable manner such as pins, rivets, and other types of fasteners. Additionally, it will be appreciated that while the illustrated embodiment indicates the use of two links 320, it will be appreciated that one only link or more that two links may also be used. The links 320 are preferably rotatably or pivotally attached to the arms 306 and the bracket 302. As discussed below, the attachment of the links 320 to the arms 306 and bracket 302 allows movement of the arms relative to the base.

The adjustable transport assembly 300 may also include a brace or other structure 334 that is sized and configured to connect the bracket 302 to the base 200 and the post 102 to the base. The brace 334 preferably has a generally C-shaped or channel shaped structure with a connecting portion and two opposing sides or flanges. Two generally aligned openings or holes 334A are located in the sides of the brace 334 and the pin 208 is disposed through the openings in the post 102 and the brace. This allows the post 102 to be secured to the brace 334. In addition, the brace 334 includes an opening or hole 334B disposed in the connecting portion of the brace. The opening 334B in the brace 334 is preferably sized and configured to receive a bolt or other suitable fastener 336. The bolt 336 preferably passes through the opening 334B in the brace 334, the hole 202F in the base 202, and the hole 304A in the bracket 302. The bolt 336 is preferably secured in position by a nut 338. Desirably, the bolt 336 pivotally connects the bracket 302 to the base 202 which, as discussed below, allows the adjustable transport assembly 300 to pivot or rotate relative to the base. It will be appreciated, however, that the adjustable transport assembly 300 does not have to be pivotally connected to the base 202 and the post 102 does not have to be connected to the brace 334.

Figure 4A:
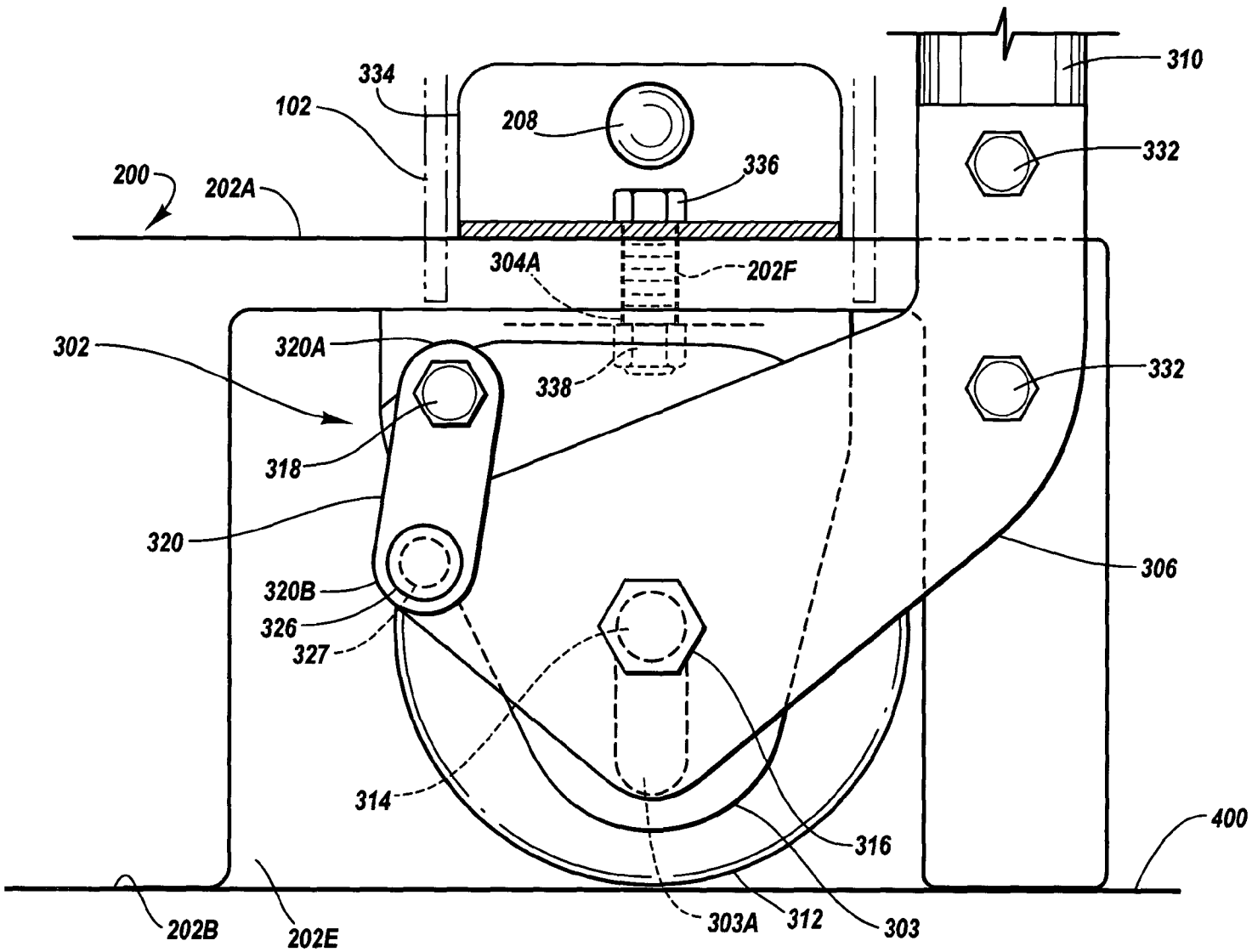
FIG. 4A is an enlarged, exploded, partial cross-sectional side view of a portion of the portable basketball system shown in FIG. 1, illustrating the adjustment assembly in a first position.

As seen in FIG. 4A, the adjustable transport assembly 300 is shown in a stationary or first position in which the portable basketball system 100 is held in a generally fixed position relative to a playing or support surface 400. In this stationary position, the handle 310 is in a generally vertical position and it is generally aligned with the post 102. In addition, in this stationary position, the base 200 is in the lowered position such that at least a portion of the lower surface 202B of the base 200 is in contact with the playing or support surface 400. This contact between the base 200 and the support surface 400 helps maintain the portable basketball system 100 in the generally fixed location. Depending upon the particular implementation, the wheel 312 may be in contact with the support surface 400, as indicated in FIG. 4A, or the wheel may be spaced apart from the support surface. It will be appreciated that the handle 310 does not have to be in a generally vertical orientation or generally parallel to the post 102 when the adjustable transport assembly 300 is in the stationary position. In contrast, the handle 310 may be in any suitable position or location in this stationary position.

Desirably, when the wheel 312 and the base 200 are positioned as shown in FIG. 4A, the wheel provides little or no support to the base 200. Thus, although the wheel 312 may be in contact with the support surface 400, the portable basketball system 100 is held in a generally fixed location because at least a portion of the base 200 is in contact with the support surface 400.

Figure 4B:
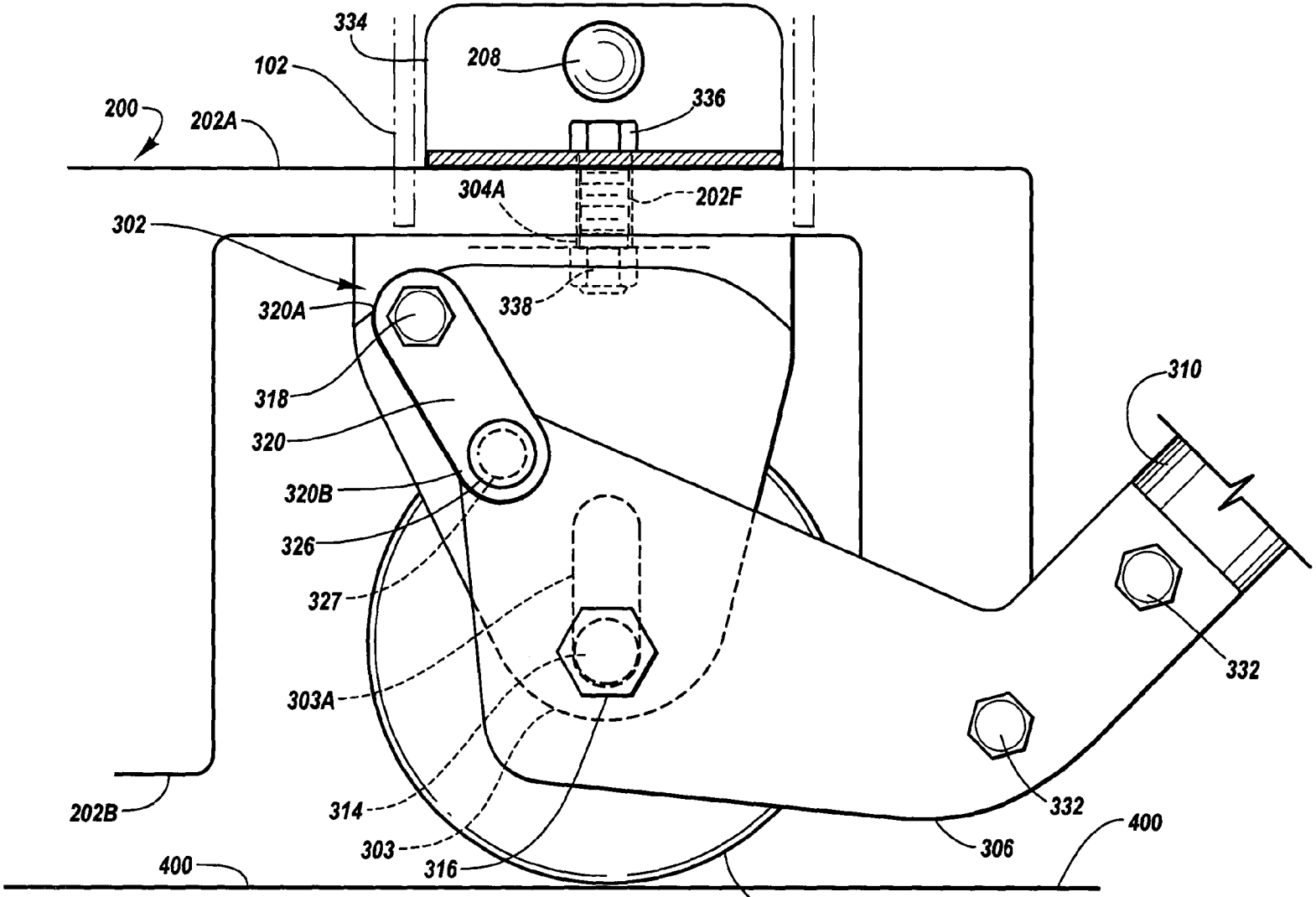
FIG. 4B is an enlarged, exploded, partial cross-sectional side view of a portion of the portable basketball system shown in FIG. 1, illustrating the adjustment assembly in a second position.

Alternatively, as shown in FIG. 4B, the handle 310 may be in an intermediate position in which the handle 310 is disposed towards the support surface 400. In this intermediate position, the wheel 312 engages the support surface 400 and at least a substantial portion of the base 200 is no longer in contact with the support surface 400.

In particular, as the handle 310 is rotated away from, for example, the substantially vertical position indicated in FIG. 4A, the arm 306 and the handle pivot about the axle 314. Additionally, as shown in the accompanying figures, the portion of the arm 306 to which the link 320 is attached begins to move upwardly, which causes the link 320 to also move upwardly. Because the link 320 is connected to the bracket 302, the upward movement of the link also causes the bracket to also move upwardly. As shown in FIG. 4B, in this intermediate position, the axle 314 and link 320 may be generally aligned. In addition, as the link 320 forces the bracket 302 in an upward direction, the axle 314 of the wheel 312 slides within the slots 303A in the sides 303 of the bracket 302. Thus, while the axle 314 and wheel 312 may remain in a generally fixed location, the bracket 302 is moved in an upward direction and the axle is disposed towards the lower end of the slot 303A. Accordingly, in this intermediate position, at least a portion of the bottom surface 202B of the base 200 is moved in a generally upward direction and out of contact with the support surface 400 and at least a portion of the base 200 is supported by the wheel 312.

One skilled in the art will appreciate that other types of structures and arrangements of the bracket 302, arms 306, wheel 312, axle 314, links 320, etc. may be used to move the base 200 relative to the playing surface 400. Thus, the implementation disclosed and discussed herein is but one exemplary structural arrangement that functions to move the base 200 relative to the playing surface 400. Accordingly, it should be understood that such structural arrangement is presented herein solely by way of example and should not be construed as limiting the scope of the present invention in any way. Rather, any other structure or combination of structures effective in implementing the functionality disclosed herein may likewise be employed. By way of example, a cam and follower arrangement may be used to move the base 200 relative to the playing surface 400.

In the intermediate position shown in FIG. 4B, the distance between the base 200 and the support surface 400 is preferably maximized and any further rotation of the handle 310 away from the vertical position desirably causes the base to descend toward the support surface. As suggested by FIG. 4B, this intermediate position may be intended to be somewhat of an unstable position in which the handle 310 is biased to return to the stationary position or a movable position. In particular, when the link 320 and the axle 314 are aligned as indicated in FIG. 4B, the base 200 may be disposed in a position where it may readily move either to the lowered position or the raised position in the event that a force is not maintained on the handle 310. The adjustable transport assembly 300, however, may be configured such that the handle 310 tends to remain in this intermediate position if desired.

Figure 4C:
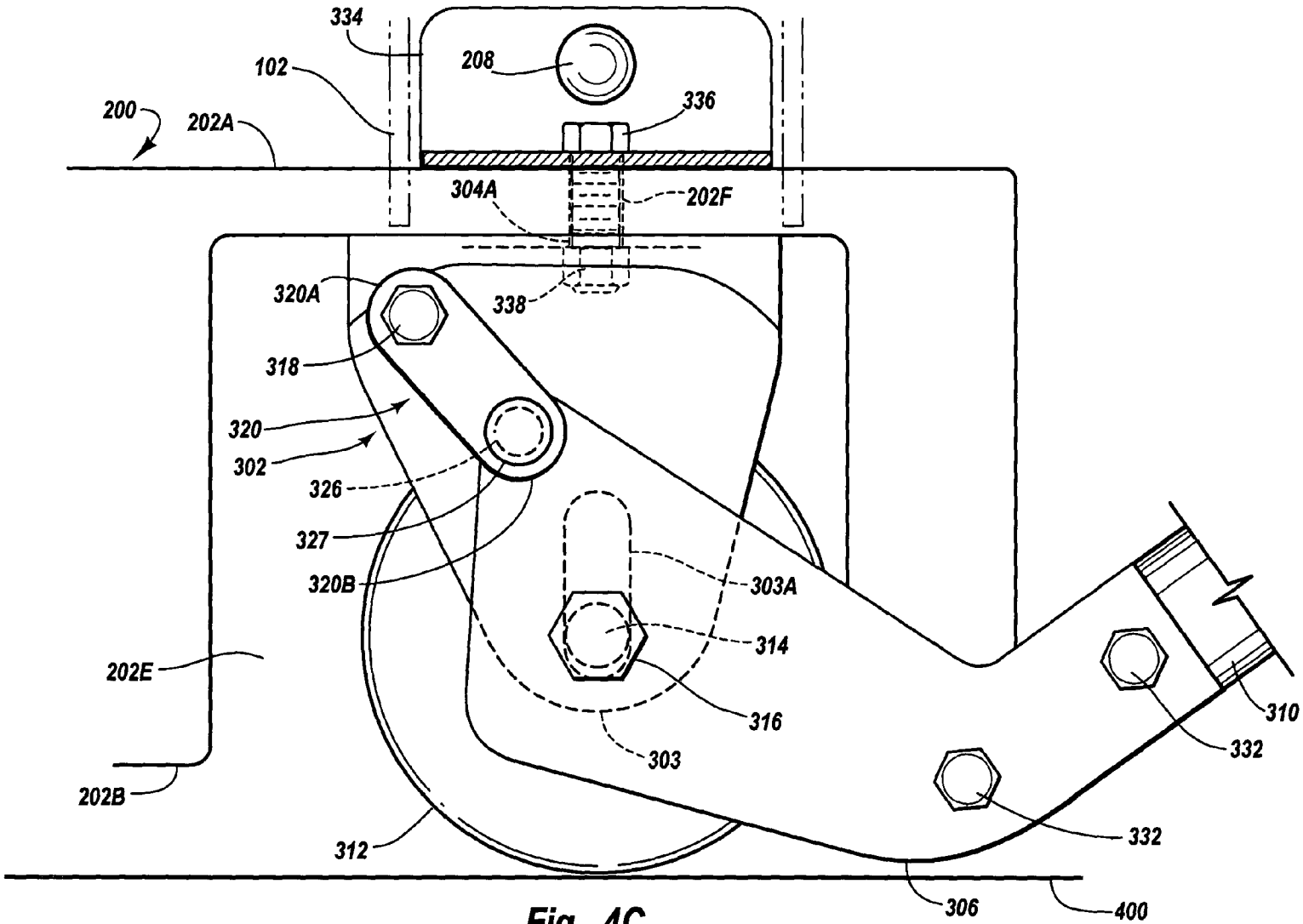
FIG. 4C is an exploded, enlarged, partial cross-sectional side view of a portion of the portable basketball system shown in FIG. 1, illustrating the adjustment assembly in a third position.

As shown in FIG. 4C, the handle 310 has been rotated downwardly past the position illustrated in FIG. 4B, with the result that the link 320 has moved from a position where it is substantially linearly aligned with the axle 314, to a slightly over-rotated position. One result of this further rotation of the link 320 is that the distanced separating the lower portion of the base 200 to the support surface 400 may be slightly decreased from the position shown in FIG. 4B. Additionally, in this position, the axle 314 is disposed slightly away from the lower portion of the slot 303A in the bracket 302. At this point, further rotation of the handle 310 toward the support surface 400 is prevented by stop 306D on the arm 306. In particular, the stop 306D contacts the side portion 303 of the bracket 302, at which point further rotation of the handle 310 is not possible. The stop 306D may have other suitable arrangements and configurations, and the arm 306 is not required to have a stop.

When the adjustable transport assembly 300 is oriented as indicated in FIG. 4C, the transport assembly may be in a relatively stable position as a result of the over-rotation of link 320 relative to the axle 314. Moreover, when the link 320 is disposed in this over-rotated position, the link 320 and bracket 302 may cooperatively tend to resist rotation of the handle 310 to the stationary position indicated in FIG. 4A. In particular, the weight of the base 200 may act downwardly on the bracket 302, thereby resisting the upward movement of the base that would be required for the handle 310 and link 320 to return to the stationary position shown in FIG. 4A. Thus, when the handle 310 is disposed as indicated in FIG. 4C, the arrangement of the link 320 and the bracket 302 provide a measure of stability with regard to the positioning of the handle 310. Advantageously, this allows the portable basketball assembly 100 to be readily moved from one location to another without the base 200 inadvertently resuming the stationary position shown in FIG. 4A where at least a substantial portion of the base 200 contacts the support surface 400. It will be appreciated that portable basketball assembly 100 could be moved, if desired, in either of the positions shown in FIG. 4B or FIG. 4C. In fact, the portable basketball assembly could be moved at any time when a substantial portion of the base 200 is not in contact with the support surface 400.

When the adjustable transport assembly 300 is disposed as indicated in FIG. 4C, the base 200 and, thus, the portable basketball system 100, can be readily and reliably transported from location to another. Further, because at least a portion of a force exerted on the handle 328 can be exerted substantially horizontally on the axle 314, the handle 310 can be used to both push and/or pull the portable basketball system 100. This allows the user to readily maneuver the portable basketball system 100 as desired. Moreover, the ability of the bracket 302 to rotate within the recess 202E in the base 200 further contributes to the maneuverability of the base 200 and portable basketball system 100 because it can be moved forwards, backwards and sideways, as desired by the user. Thus, the adjustable transport assembly 300 may allow the portable basketball system 100 to be steered.

When it is desired to lower the base 200 from the position illustrated in FIG. 4C to the position illustrated in FIG. 4A, the user simply rotates the handle away from the support surface 400 and towards a vertical position. As the handle 310 is being rotated, the link 320 rotates through the position shown in FIG. 4B and into the position illustrated in FIG. 4A. As discussed above, when the handle 310 is in the generally vertical position and at least a substantial portion of the base 200 contacts the support surface 400, the portable basketball system 100 is held in a generally stationary position.

It will be appreciated that various aspects of the geometry and arrangement of the adjustable transport assembly 300 may be varied as desired to suit a particular application or to achieve a desired result. By way of example, the geometry and arrangement of the link 320, arm 306 and/or bracket 302 may be varied independently or in various combinations as may be desired to suit the requirements of a particular application or implementation. Further, aspects of the geometry and arrangement of the base 200 and adjustable transport assembly 300 may likewise be varied as desired to suit a particular application or to achieve a desired result. By way of example, the configuration of the recess 202E in the base 200 may be adjusted to provide for a larger, or smaller, range of lateral motion of the handle 310.

Although this invention has been described in terms of certain preferred embodiments, other embodiments apparent to those of ordinary skill in the art are also within the scope of this invention. Accordingly, the scope of the invention is intended to be defined only by the claims that follow.

The invention claimed is:

1. A portable basketball system comprising:

a basketball goal;

a support structure being sized and configured to support the basketball goal above a playing surface;

a base being sized and configured to support the support structure, and an adjustment assembly that is capable of being moved between a first position in which the portable basketball system is held in a generally fixed position relative to the playing surface and a second position in which the portable basketball system is readily movable relative to the playing surface, the adjustment assembly comprising:

a bracket at least partially disposed within a recess in the base;

an arm disposed proximate to the bracket, the arm being separate and distinct from the bracket;

a link pivotally connecting the arm to the bracket to provide a first connection between the arm and the bracket, the link including a first portion pivotally connected to the arm and a second portion pivotally connected to the bracket; and a wheel assembly connected to the bracket and the arm, the wheel assembly providing a second connection between the arm and the bracket that is distinct from the first connection between the arm and the bracket;

wherein at least a portion of the base contacts the playing surface when the adjustment assembly is in the first position.

2. The portable basketball system as in claim 1, wherein the wheel assembly includes a wheel at least partially disposed within the bracket.

3. The portable basketball system as in claim 1, wherein the bracket has generally U-shaped configuration with a first side, a second side and a connection portion.

4. The portable basketball system as in claim 1, wherein the wheel assembly includes an axle with one or more wheels attached to the axle.

5. The portable basketball system as in claim 1, wherein the wheel assembly includes an axle and the arm rotates about the axle of the wheel assembly when the adjustment assembly is moved from the first position to the second position.

6. The portable basketball system as in claim 1, further comprising a wheel attached to the base.

7. The portable basketball system as in claim 1, wherein movement of the adjustment assembly between the first position and the second position does not require substantial tilting of the base.

8. The portable basketball system as in claim 1, wherein a bottom surface of the base remains generally parallel to the playing surface when the adjustment assembly is moved between the first position and the second position.

9. The portable basketball system as in claim 1, further comprising a handle connected to the arm, the handle being sized and configured to move the adjustment assembly between the first position and the second position.

10. The portable basketball system of claim 1, wherein the wheel assembly includes an axle that is disposed through an opening in the arm and a slot in the bracket, the axle being movable within the slot when the adjustment assembly moves between the first position and the second position.

11. The portable basketball system of claim 1, wherein the bracket is pivotally connected to the base to allow the wheel assembly to turn relative to the base.

12. The portable basketball system as in claim 1, further comprising an interior cavity of the base that is sized and configured to receive ballast material.

13. A portable basketball system comprising:

a basketball goal;

a support structure being sized and configured to support the basketball goal above a playing surface;

a base being sized and configured to support the support structure, and an adjustment assembly that is capable of being moved between a first position in which the portable basketball system is held in a generally fixed position relative to the playing surface and a second position in which the portable basketball system is readily movable relative to the playing surface, the adjustment assembly comprising:

a bracket at least partially disposed within a recess in the base;

an arm disposed proximate to the bracket;

a link pivotally connecting the arm to the bracket; and a wheel assembly connected to the bracket and the arm;

wherein at least a portion of the base contacts the playing surface when the adjustment assembly is in the first position;

wherein the wheel assembly includes an axle that is disposed through an opening in the arm and a slot in the bracket, the axle being movable within the slot when the adjustment assembly moves between the first position and the second position; and wherein the bracket is pivotally connected to the base to allow the wheel assembly to turn relative to the base.

14. A portable basketball system comprising:

a basketball goal;

a support structure being sized and configured to support the basketball goal above a playing surface;

a base being sized and configured to support the support structure, and an adjustment assembly that is capable of being moved between a first position in which the portable basketball system is held in a generally fixed position relative to the playing surface and a second position in which the portable basketball system is readily movable relative to the playing surface, the adjustment assembly comprising:

a bracket at least partially disposed within a recess in the base;

an arm disposed proximate to the bracket;

a link pivotally connecting the arm to the bracket; and a wheel assembly connected to the bracket and the arm;

wherein at least a portion of the base contacts the playing surface when the adjustment assembly is in the first position; and wherein the bracket includes two generally opposing sides and an axle of the wheel assembly is disposed within a slot in the two generally opposing sides, the axle being movable within the slots when the adjustment assembly moves between the first position and the second position.

15. A portable sports system that is sized and configured to be positioned on a support surface, the portable sports system comprising:

a base include an interior cavity that is capable of receiving ballast material; and an adjustable transport assembly connected to the base, the adjustable transport assembly comprising:

a wheel assembly including an axle; and an adjustment assembly that is capable of being moved between a first position in which the portable sports system is held in a generally fixed position relative to the support surface and a second position in which the portable sports system is readily movable relative to the support surface, the adjustment assembly comprising:

a bracket;

a pair of arms disposed on each side of the bracket, each arm of the pair of arms being separate and distinct from the bracket; and a pair of links connecting the arms to the bracket to provide a first connection between the pair of arms and the bracket, each link being sized and configured so that movement of the adjustment assembly from the first position to the second position corresponds to a change in position of the base member, each link including a first portion connected to one of the arms and a second portion connected to the bracket;

wherein the wheel assembly is connected to the pair of arms and the bracket to provide a second connection between the pair of arms and the bracket that is distinct from the first connection between the pair of arms and the bracket.

16. The portable sports system as in claim 15, wherein the adjustable transport assembly is rotatably attached to the base member.

17. The portable sports system as in claim 15, further comprising a handle connected to the pair of arms, wherein motion of the handle towards the support surface corresponds to motion of the base member away from the support surface, and motion of the handle away from be support surface corresponds to motion of the base member toward the support surface.

18. A portable basketball system for use in connection with a support surface, the portable basketball system comprising:

a basketball goal;

a support structure supporting the basketball goal above the support surface;

a base being sized and configured to support the support structure, the base including an interior cavity that is capable of receiving ballast material, the base including a lower portion that is sized and configured to contact the support surface; and an adjustment assembly that is capable of being moved between a first position in which the portable basketball system is held in a generally fixed position relative to the support surface and a second position in which the portable basketball system is movable relative to the support surface, the adjustment assembly comprising:

a bracket including at least one elongated slot;

an arm disposed proximate to the bracket and including an opening;

a link pivotally connecting the arm and the bracket;

a portion of a wheel assembly disposed through the at least one elongated slot in the bracket and the opening in the arm, the movement of the adjustment assembly from the first position to the second position causes the portion of the wheel assembly to move within the slot; and a handle connected to the arm.

19. A portable basketball system comprising:

a basketball goal;

a base;

a support structure interconnecting the base and the basketball goal; and an adjustment assembly movable relative to the base between a first position in which the portable basketball system is held in a generally fixed position relative to a playing surface and a second position in which the portable basketball system is movable relative to the playing surface, the adjustment assembly comprising:

a bracket, an arm, a link pivotally attaching the arm and the bracket, a wheel assembly including an axle that is disposed through an opening in the arm and an elongated slot in the bracket, and a handle that is connected to the arm;

wherein movement of the handle causes the adjustment assembly to move relative to the base between the first position and the second position.

20. The portable basketball system as in claim 19, further comprising an interior cavity of the base that is capable of receiving a ballast material.

21. The portable basketball system as in claim 19, wherein a portion of the base contacts the playing surface in the first position to hold the basketball goal in the generally fixed position relative to the playing surface.

22. The portable basketball system as in claim 19, wherein the wheel assembly includes one or more wheels.

23. The portable basketball system as in claim 19, further comprising a wheel connected to the base.

24. A portable basketball system comprising:

a basketball goal;

a base;

a support structure interconnecting the base and the basketball goal;

a wheel assembly including an axle and at least one wheel; and an adjustment assembly that is sized and configured to move the wheel assembly relative to the base between a first position in which the basketball goal is held in a generally fixed position relative to a playing surface and a second position in which the basketball goal is movable relative to the playing surface, the adjustment assembly comprising:

a bracket connected to the base, the bracket including two elongated slots and the axle of the wheel assembly being disposed within the slots, the axle of the wheel assembly being movable within the slots when the adjustment assembly moves between the first and second positions;

an arm including an opening and the axle of the wheel assembly disposed within the opening;

a link connecting the arm and the bracket; and a handle connected to the arm;

wherein movement of the handle causes the arm to rotate about the axle of the wheel assembly and the link to move the bracket relative to the arm so that the adjustment assembly is moved from the first position to the second position.

25. A portable basketball system comprising:

a support structure for supporting a basketball goal above a playing surface;

a base that is sized and configured to support the support structure above the playing surface;

a wheel assembly including an axle connected to the base; and an adjustment mechanism that is capable of being moved between a first position in which the portable basketball system is held in a generally fixed position relative to a support surface and a second position in which the portable basketball system is readily movable relative to the support surface, the adjustment mechanism comprising:

a bracket including two generally opposing sides, each of the generally opposing sides of the bracket including an opening and an elongated slot;

a pair of arms disposed proximate the generally opposing sides of the bracket, each of the arms including an opening; and a link pivotally connecting each of the pair of arms to the bracket;

wherein the axle of the wheel assembly is disposed through the opening in each of the pair of arms and through the slot in each of the generally opposing sides of the bracket, the axle being movable within the slot in each of the generally opposing sides of the bracket when the adjustment mechanism moves between the first position and the second position.

26. The portable basketball system as in claim 25, further comprising a wheel attached to the axle of the wheel assembly and the wheel being at least partially disposed between the generally opposing sides of the bracket.

27. The portable basketball system as in claim 25, further comprising a handle attached to the pair of arms, the motion of the handle in a first direction causes movement of the adjustable mechanism from the first position to the second position, and the motion of the handle in a second direction causes movement of the adjustable mechanism from the second position to the first position.

28. The portable basketball system as in claim 25, wherein motion of the handle in the first direction causes rotation of the arms about the axle and the relative upward movement of the bracket relative to the arms.

29. The portable basketball system as in claim 25, wherein the arm rotates about the axle when the adjustment mechanism is moved from the first position to the second position.

30. The portable basketball system as in claim 25, further comprising a wheel attached to the base.

31. The portable basketball system as in claim 25, wherein the bracket is sized and configured to be pivotally connected to the base to allow the wheel assembly to turn relative to the base.

32. A portable basketball system comprising:

a support structure for supporting a basketball goal above a playing surface;

a base that is sized and configured to support the support structure relative to the playing surface, the base including an exterior surface and an interior portion that is capable of receiving ballast material; and an adjustment mechanism that is capable of being moved between a first position in which the portable basketball system is held in a generally fixed position relative to the playing surface and a second position in which the portable basketball system is movable relative to the playing surface, the adjustment mechanism comprising:

a bracket that is at least generally disposed proximate an exterior surface of the base;

at least one brace disposed proximate to the bracket, the brace being separate and distinct from the bracket;

at least one link connecting the brace and the bracket to provide a first connection between the brace and the bracket, the link including a first portion connected to the brace and a second portion connected to the bracket; and a wheel assembly including at least one wheel, the wheel assembly being connected to the brace and the bracket to provide a second connection between the brace and the bracket that is distinct from the first connection between the brace and the bracket, the wheel assembly facilitating movement of the portable basketball system relative to the playing surface when the adjustment mechanism is in the second position.

33. The portable basketball system as in claim 32, wherein the bracket is at least partially disposed within a recess in the base.

34. The portable basketball system as in claim 32, wherein the bracket can pivot relative to the base to allow the wheel assembly to pivot relative to the base.

35. The portable basketball system as in claim 32, wherein the at least one brace includes a first brace disposed proximate a first side of the bracket and a second brace disposed proximate a second side of the bracket.

36. The portable basketball system as in claim 32, further comprising a handle attached to the at least one brace.

37. The portable basketball system as in claim 36, wherein the handle is sized and configured to move the adjustment mechanism between the first position and the second position.

38. The portable basketball system as in claim 32, further comprising an axle of the wheel assembly, the axle being disposed through an opening in the bracket and an opening in the at least one brace.

39. The portable basketball system as in claim 38, wherein the opening in the bracket is an elongated slot and the axle moves within the elongated slot when the adjustment mechanism is moved between the first and second positions.

40. The portable basketball system as in claim 32, further comprising one or more elongated slots in the bracket and one or more openings in the at least one brace; wherein an axle of the wheel assembly is disposed within the slots and the openings.

41. The portable basketball system as in claim 32, wherein the bracket includes two sides and an axle of the wheel assembly is disposed within a slot in each of the two sides of the bracket, the axle being movable within the slots when the adjustment mechanism moves between the first position and the second position.

42. A portable basketball system comprising:

a basketball goal;

a support structure being sized and configured to support the basketball goal above a playing surface;

a base being sized and configured to support the support structure, and an adjustment assembly that is capable of being moved between a first position in which the portable basketball system is held in a generally fixed position relative to the playing surface and a second position in which the portable basketball system is readily movable relative to the playing surface, the adjustment assembly comprising:

a bracket at least partially disposed within a recess in the base;

an arm disposed proximate to the bracket;

a link pivotally connecting the arm to the bracket; and a wheel assembly connected to the bracket and the arm;

wherein at least a portion of the base contacts the playing surface when the adjustment assembly is in the first position; and wherein the wheel assembly includes an axle that is disposed through an opening in the arm and a slot in the bracket, the axle being movable within the slot when the adjustment assembly moves between the first position and the second position.

* * * * *

UNITED STATES PATENT AND TRADEMARK OFFICE

CERTIFICATE OF CORRECTION

PATENT NO. : 7,118,500 B2
APPLICATION NO. : 10/648174
DATED : October 10, 2006
INVENTOR(S) : Nye et al.

It is certified that error appears in the above-identified patent and that said Letters Patent is hereby corrected as shown below:

Column 4
Line 7, change “limits” to --limit--

Column 6
Line 61, change “1 00” to --100--

Column 7
Line 15, before “306”, change “are” to --arm--

Column 12
Line 2, before “generally”, insert --a--

Column 13
Line 31, change “include” to --including--

Signed and Sealed this

Third Day of July, 2007

JON W. DUDAS
*Director of the United States Patent and Trademark Office*